US005321868A

United States Patent [19]

Coulson et al.

[11] Patent Number: 5,321,868

[45] Date of Patent: Jun. 21, 1994

[54] ERGONOMIC SQUEEGEE FOR SILK SCREENING

[76] Inventors: Cathy Coulson; William H. Wright, both of P.O. Box 5556, Eugene, Oreg. 97405

[21] Appl. No.: 20,049

[22] Filed: Feb. 18, 1993

[51] Int. Cl.[5] ..... B41F 15/44

[52] U.S. Cl. ..... 15/245.1; 15/143.1; 15/245; 16/111 R; 101/114

[58] Field of Search ..... 15/143.1, 235.4, 236.01, 15/245, 245.1, 246; 16/111 R; 30/169; 101/114, 123

[56] References Cited

U.S. PATENT DOCUMENTS

| | | | |
|---|---|---|---|
| 1,412,728 | 4/1922 | Werner | 30/169 |
| 1,555,145 | 9/1925 | Naslin | 15/245 |
| 1,609,704 | 12/1926 | Ellis | 15/235.4 |
| 2,047,635 | 7/1936 | Johst . | |
| 2,162,117 | 6/1939 | Perry | 15/143.1 |
| 2,217,369 | 10/1940 | Jacobsen et al. | 15/235.4 |
| 2,380,855 | 7/1945 | Lower | 30/169 |
| 2,466,719 | 4/1949 | MacKearnin . | |
| 2,571,685 | 10/1951 | D'Autremont | 101/123 |
| 2,686,363 | 8/1954 | Anderson | 30/169 |
| 2,871,899 | 2/1959 | Coyle et al. | 16/111 R |
| 3,072,955 | 1/1963 | Mitchell . | |
| 3,585,101 | 6/1971 | Stratton et al. | 16/111 R |
| 3,676,888 | 7/1972 | Akers | 15/245 |
| 3,692,155 | 9/1972 | Laurita . | |
| 4,097,951 | 7/1978 | Hurtt | 15/245.1 |
| 4,611,363 | 9/1986 | Samuelsson | 15/245 |
| 4,722,296 | 2/1988 | Bowskill et al. | 16/111 R |
| 5,101,530 | 4/1992 | Hansen et al. | 15/245 |

FOREIGN PATENT DOCUMENTS

| | | | |
|---|---|---|---|
| 60242 | 4/1954 | France | 15/245 |
| 652343 | 11/1985 | Switzerland | 101/114 |
| 1753 | of 1909 | United Kingdom | 15/245 |
| 117346 | 7/1918 | United Kingdom | 15/143.1 |
| 333028 | 8/1930 | United Kingdom | 15/245 |
| 2185209 | 7/1987 | United Kingdom | 16/11 R |

*Primary Examiner*—Timothy F. Simone
*Assistant Examiner*—Mark Spisich
*Attorney, Agent, or Firm*—Kolisch, Hartwell, Dickinson, McCormack & Heuser

[57] ABSTRACT

An improved squeegee and method of ergonomically modifying a conventional squeegee, is provided. A squeegee includes a rigid handle having a convex top side, opposite from a bottom side, and opposing concave faces longitudinally disposed between the top and bottom sides of the handle. A blade is attached to the bottom side of the handle. A compressible pad is removably secured to the convex topside of the handle providing maximum padding to the palmer regions of the printer's hands. The pad tapers to a minimum thickness at distal edges which are located on or near the concave faces of the handle.

7 Claims, 2 Drawing Sheets

ERGONOMIC SQUEEGEE FOR SILK SCREENING

FIELD OF THE INVENTION

The invention relates to squeegees which are used for silk screening. In particular, the invention involves a squeegee handle pad which provides cushioning to the palm, fingers and thumb of the printer's hands without sacrificing the printer's ability to forcefully grip and accurately apply the squeegee blade to the screen.

BACKGROUND OF THE INVENTION

The art of screen printing has been practiced for over 3900 years and originated in ancient China. The first printed images were made using stencils intricately held together with strands of human hair and other natural fibers. Later a fine mesh woven from silk was developed; hence the origin of "silk" screening. Over the years screen printing technology has evolved to provide emulsions that block the screen to develop the design, synthetic fabrics that have replaced the silk, and an ever growing assortment of inks, but the basic screen printing tools and principles developed centuries ago are still employed today.

For "hand screening" the basic tool that is used to force ink through the open untreated part of the screen is a squeegee, which includes a tear-drop shaped wooden handle, and a "blade" which is normally made of rubber or plastic. The blade typically wears out and is changed occasionally, but the wooden handle almost never wears out. Wood is a good material for the handle because, unlike most plastic materials, it doesn't "dry out". Wood is also a good material of choice for the handle because it is hard and provides a good solid base which can be gripped tightly in order to maintain and precisely control the erect orientation of the squeegee handle relative to the screen.

One significant problem which has existed for many years and is receiving increasing attention in the screen printing industry today, is that prolonged forceful gripping of the squeegee handle can cause debilitating injury to the artist's hands, particularly relating to the median nerve in the palm region of the hand, i.e., commonly known as carpel tunnel syndrome. Carpel Tunnel Syndrome is a physical condition that affects the hand and wrist. The carpel tunnel is on the palm side of the wrist. The median nerve passes through the carpel tunnel and supplies sensation and motor nerve function to the palm from the thumb to the middle finger. Carpel Tunnel Syndrome results from trauma to the hand causing a lack of circulation and/or compression of the carpel tunnel on the median nerve. This results in numbness, tingling, and/or dull pain in the fleshy muscular region of the palm near the thumb, and other areas of the hand that relate to the median nerve. This can result in a decline in grip strength, and pain associated with flexion of the wrist or fingers. In extreme cases, Carpel Tunnel Syndrome may require the printer to refrain from screen printing for an extended period.

Silk screeners have also been known to develop tendinitis from extensive use of the hard handled squeegee. Tendinitis is an inflammation of a tendon, and is commonly found around deposits of calcium associated with the shoulder or other tendons. Tendinitis often causes so much pain that the person is unable or unwilling to move the affected tendon.

These physical problems result at least in part from the unyielding rigidity and hardness of the wooden handle, features which are necessary for the purpose of forcefully gripping and precisely controlling the erect orientation of the squeegee blade. Prolonged periods of tightly gripping and manipulating the hard wooden handle inevitably eventually causes injury to the printer's hands. Even though this problem has existed for many years, apparently no one has previously conceived of a satisfactory solution to prevent and/or treat these physical injuries.

Although others have previously padded the handles of various tools or instruments, pads have not previously been used on squeegee handles apparently because of the peculiar tear-dropped shape of the handle, the unusual style of gripping the squeegee handle, and the unique requirement that the printer be able to forcefully press the blade against the screen while tightly gripping and controlling the substantially erect orientation of the squeegee blade primarily by applying forceful digital pressure on opposing sides of the squeegee handle. In this regard, the screen printing squeegee handle is not analogous to other types of tool handles which are gripped and applied differently.

Some of the problems addressed by the present invention have been observed by others and are currently the subject of other development work to construct a more "ergonomically" kind squeegee handle. For example, a WILFLEX® power-glide squeegee handle is now being sold by Flexible Products Company in Marietta, Ga. and Santa Ana, Calif. The present inventor is unaware of the invention date for the WILFLEX® squeegee handle, and therefore makes no admission or representation as to whether the WILFLEX® handle is or is not prior art to the present invention. Nevertheless, the WILFLEX® handle, unlike the conventional tear-drop shaped squeegee handle, is apparently shaped to accommodate the printer's hands. The WILFLEX® sponsor claims that its squeegee handle design helps "relieve operator fatigue, increase production, and lessen the risk of Carpal Tunnel Syndrome". However, there are several notable problems with the WILFLEX® squeegee handle. First, it appears that the WILFLEX® handle is made of a hard material which will insult the printer's hands similar to the conventional wooden squeegee handle. Second, in order to use the WILFLEX® handle, a printer must buy a whole new squeegee. Thus, the WILFLEX® squeegee does not offer a way to modify the many conventional tear-drop shaped wooden squeegee handles which are in use today, in order to relieve operator fatigue and lessen the risk of carpel tunnel syndrome. Third, the lateral sides of the WILFLEX® handle are asymmetrical. Therefore, the printer can only use one side of the blade without removing, flipping and replacing the blade into the squeegee handle. This is a disadvantage compared to the conventional squeegee which employs a symmetrical handle, thereby allowing the printer to use both sides of the blade by merely flipping the entire squeegee.

Therefore, it is an object of the present invention to provide a squeegee handle design which allows forceful application and adroit digital control of the squeegee while lessening the risk of injury to the printer's hands.

Another object is to provide a way of modifying a hard squeegee handle to lessen the risk of hand injuries without sacrificing squeegee blade control.

Another object is to provide an ergonomic squeegee design which can be used by a printer while recovering from a hand injury without causing additional injury.

Another object is to provide a cushion for a conventional squeegee handle which can be removed and exchanged as needed during the relatively long life of the squeegee handle.

Another object is to improve the gripability of a conventional wooden squeegee handle.

SUMMARY OF THE INVENTION

The objectives stated above and other important objectives are achieved by the present invention which provides a specially designed removable pad for a screen printing squeegee handle. The squeegee includes a rigid handle having a convex top side opposite from a bottom side, and opposing concave faces longitudinally disposed between the top and bottom sides. A blade is attached to the bottom side of the squeegee handle. A compressible pad is removably secured to the convex top side of the handle.

In a preferred embodiment the pad has a variable thickness including a maximum thickness in a central region corresponding to the top side of the handle so that a maximum amount of padding is provided to the palm region of the printer's hand. Adjoining the central region of the pad are two lateral regions each having a distal edge extending onto a portion of one of the concave faces. The central region has a substantially constant thickness and each lateral region tapers to a minimum thickness at its distal edge. The back side of the pad has adhesive for fixing the pad to the squeegee handle.

DETAILED DESCRIPTION OF THE PREFERRED EMBODIMENTS

The shape of the screen printing squeegee and the way it is gripped and applied is unusual. The printer typically folds her hands over the convex top side of the squeegee handle so that the top side contacts the palm, the back lateral side contacts the thumb and the front lateral side contacts the fingers. In use, the printer pulls the squeegee blade over the screen. Initially the printer pulls the squeegee blade at approximately a forty five degree angle relative to the screen. The angle between the blade and the screen is gradually increased up to slightly less than ninety degrees at the end of the pass. The printer must apply considerable downward force against the top of the squeegee handle so that the blade presses firmly against the screen. Due to the angle between the squeegee and the screen, and the significant downward force applied to the squeegee handle primarily via the palm and fingers, the printer must use a firm digital grip on the sides of the handle in order to maintain the desired angle, translation rate and ink application across the screen.

It has been discovered that a compressible pad extending over the top of the squeegee handle provides extremely beneficial pressure relief to the palm of the hand, by cushioning and by opening up the hand, thereby dispersing the upward pressure which is otherwise detrimentally focused against a relatively small region of the hand by the unyielding hard surface of the top side of the squeegee handle. By limiting the width of the pad and by tapering down the thickness of the lateral regions of the pad, the benefits to the palm are realized and the printer's ability to precisely control and apply the squeegee blade to the screen is improved.

Figure 1:
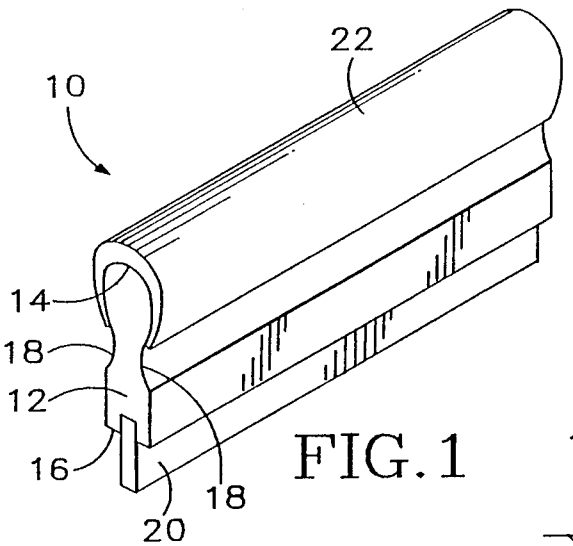
FIG. 1 is a perspective view of a padded squeegee handle in accordance with a first embodiment of the present invention.

A preferred embodiment of the present invention is shown in FIG. 1. The padded squeegee 10 includes a rigid handle 12 which has a cross-sectional tear-drop shape. The handle 12 has a convex top side 14 opposite from a bottom side 16. Opposing concave faces 18 are longitudinally disposed between the top side 14 and the bottom side 16 of the handle 12. The bottom side 16 of the handle 12 has a slot for receiving the squeegee blade 20. A pad 22 is removably fixed via adhesive to the convex top side 14 of the squeegee handle 12.

Figure 2:
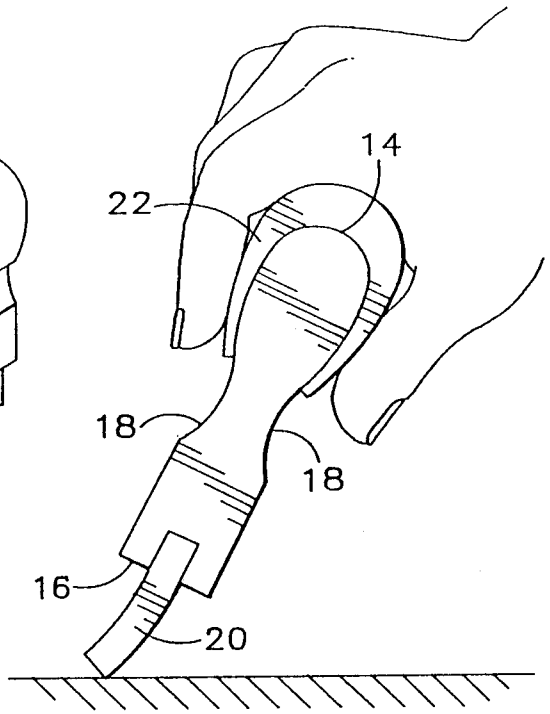
FIG. 2 is a side view of a padded squeegee handle in actual use, according to a first embodiment of the present invention.

Screen printing squeegees come in various sizes, and it is contemplated that the squeegee handle pad be cut to a length approximately equal to the length of squeegee handle. Most squeegee handles are long enough to accommodate both of the printer's hands side-by-side. As shown in FIG. 2, the user's hand fits over the squeegee handle such that the convex upper side 14 of the handle 12 is received in the palm region of the printer's hand, while the printer's fingers extend down toward the concave faces 18 of the squeegee handle.

It can be seen in FIGS. 1 and 2 that the central region of the squeegee pad 22 has a greater thickness than the side portions. A greater amount of padding relative to the side regions, is required along the convex top side of the squeegee handle in order to prevent injury to the palm region of the printer's hand. The thickness of the lateral regions of the pad which contact the fingers, is less so that the printer can tightly grip and control the erect orientation of the tool relative to the screen. Too much padding, i.e., thickness greater than 0.25 inches, on the lateral regions of the handle where the fingers contact, has been found to be detrimental to the printer's ability to control the squeegee.

Another surprising and important benefit which has been observed with the padded squeegee handle of the present invention, is that the pad causes the hand to open wider, as shown in FIG. 2, which serves to distribute the upward force exerted by the top side of the squeegee handle over a larger area of the printer's palm. Thus, in addition to providing a cushion in the palm region the shape and orientation of the pad beneficially opens up the printer's hand and spreads out the significant vertical force which the squeegee handle exerts on the printer's palm. This feature of the invention is particularly useful for minimizing the risk of Carpel Tunnel Syndrome.

It is preferable to make the pad out of the material which resists hand slippage by producing substantial friction between the pad and the printer's hand. One of the reasons that a printer has to grip the conventional wooden handle so tightly is that there is a tendency for the printer's hand to slip over the hard smooth wood surface of the handle. In the present invention, by using a high friction pad material, a less forceful grip is required to maintain the desired orientation of the printer's hand over the handle. The amount of friction between the user's hand and the pad can be favorably increased by texturing the surface of the pad and/or selecting a material that tacks to the skin when touched. Thus, the squeegee pad of the present invention, in addition to softening the blow to the printer's hands, allows the printer to pull the squeegee across the screen with more strength and control, and with less effort.

Figure 3:
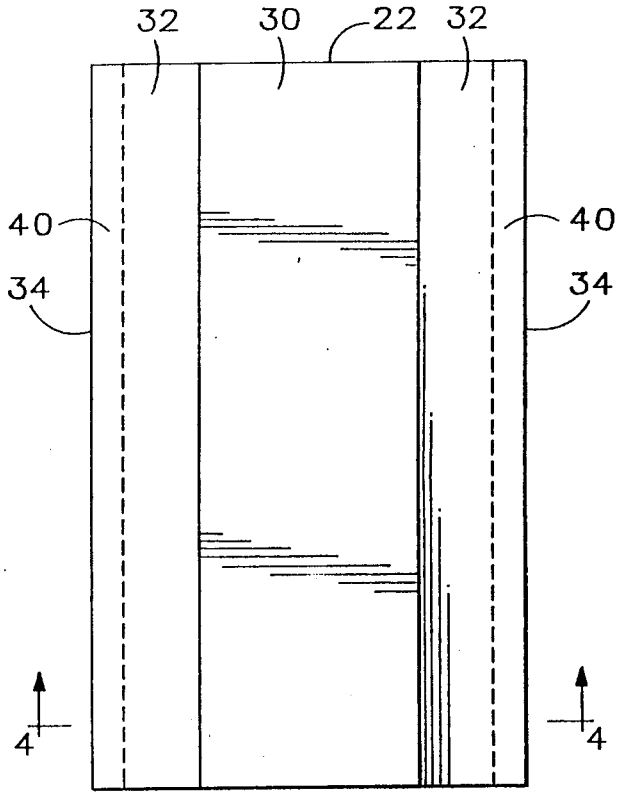
FIG. 3 is a top view of a compressible foam pad according to a first embodiment of the present invention.

FIG. 3 shows further details of the pad 22 in a preferred embodiment of the present invention. The pad 22 has a central region 30 corresponding to the top side of the squeegee handle, and two lateral regions 32 each having a distal edge 34. When the pad 22 is mounted o the squeegee handle 12 the distal edges 34 of the lateral regions 32 extend at least partially onto the concave faces 18 of the handle 12, as shown in FIGS. 1 and 2.

Figure 4:
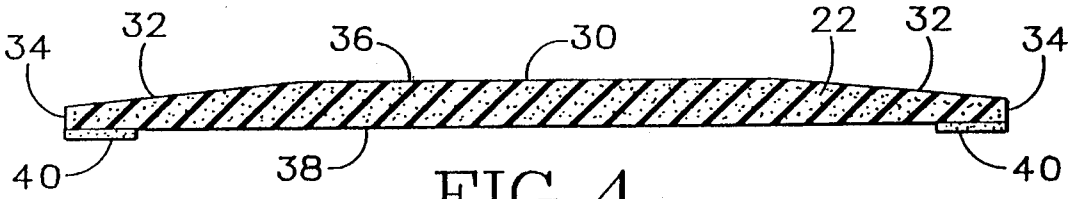
FIG. 4 is a sectional side view taken through the pad shown in FIG. 3.

As shown in FIG. 4, the thickness of the pad 22 is variable. The thickness of the central region 30 is substantially constant, and is preferably between $\frac{1}{4}$ and $\frac{1}{2}$ inch, while the lateral regions 32 taper to a minimum thickness at their distal edges 34. The top side of the pad 36 is non-planar, each lateral region sloping downward toward the distal edge 34. In contrast, the bottom side 38 of the pad 22 is substantially planar.

Two stripes of adhesive 40 are disposed longitudinally near the edges of the squeegee pad. It is preferable to use a quality and quantity of adhesive which provides strong adhesion for an extended period, while allowing removal and replacement of the pad when it wears out.

The pad shown in FIG. 3 has a length which is long enough to substantially cover the top side of a two-handed squeegee. The width of the pad is 5 inches. The width of the central region is 2.5 inches. The width of each lateral region is 1.25 inches. The thickness of the central region is 0.25 inches. Each lateral region tapers from a maximum thickness proximal to the central region of 0.25 inches, to a minimum thickness at the distal edge of 0.125 inches.

Figure 5:
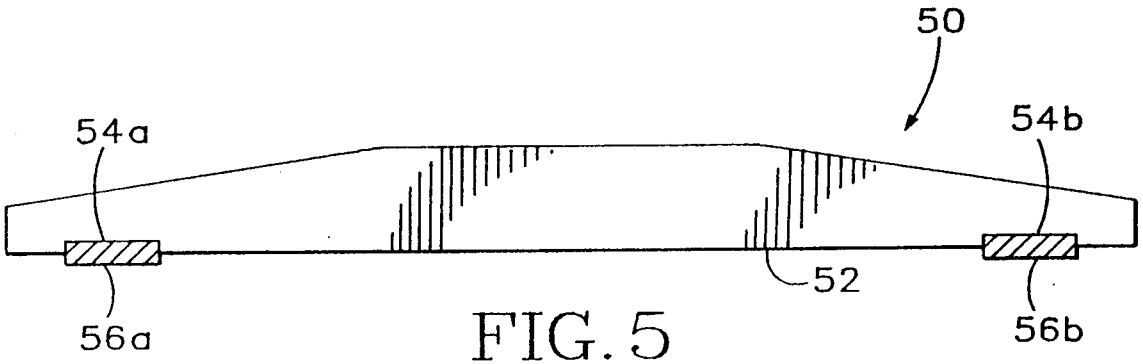
FIG. 5 is a side view of a second embodiment of the present invention.

FIG. 5 shows an alternative embodiment of the present invention in which a foam pad 50 has a bottom side 52 with inset regions 54*a* and 54*b* for receiving double stick segments of adhesive tape. For example, 3-M provides appropriate double stick tape as well as machines for insetting and applying the tape to such a pad.

The preferred embodiments of the present invention have been described in detail above with reference to the figures. However, it is recognized that numerous variations of the described invention can be produced without departing from the general spirit and scope of the invention, as claimed below.

I claim:

1. A squeegee comprising:

an elongate rigid handle having a convex top side opposite from a bottom side, and opposing concave faces longitudinally disposed between the top and bottom sides;

an elongate blade attached to the bottom side and extending longitudinally along the handle; and a compressible pad removably secured to the convex top side of the handle and extending longitudinally along the handle.

2. The squeegee of claim 1 wherein the handle has a length which is long enough to accommodate both of a printer's hands side by side so that the convex top side of the handle is received by the palmar regions of the printer's hands while the printer's fingers are positioned in the concave faces of the handle, and wherein the pad covers substantially all of the top side of the handle.

3. The squeegee of claim 2 wherein the pad extends onto at least a portion of each concave face.

4. The squeegee of claim 3 wherein the pad has a variable thickness including a maximum thickness in a central region adjacent to the top side of the handle, whereby maximum padding is provided to the palmar region of the printer's hands.

5. The squeegee of claim 2 wherein the pad has a central region adjacent to the top side of the handle, and two lateral regions each having a distal edge extending onto a portion of a respective one of the concave faces, the central region having a substantially constant thickness and each lateral region tapering to a minimum thickness at the distal edge thereof.

6. The squeegee of claim 5 wherein the thickness of the central region of the pad is approximately 0.25 inches.

7. The squeegee of claim i wherein the pad is comprised of closed-cell foam rubber.

* * * * *